US005575437A

United States Patent [19]

Campbell

[11] Patent Number: 5,575,437

[45] Date of Patent: Nov. 19, 1996

[54] KNOCKDOWN REEL

[76] Inventor: Kenneth E. Campbell, 4063 Old Orchard Rd., York, Pa. 17402

[21] Appl. No.: 372,027

[22] Filed: Jan. 12, 1995

[51] Int. Cl.[6] ..... B65H 75/22

[52] U.S. Cl. ..... 242/608.6; 242/609.1

[58] Field of Search ..... 242/608.6, 609, 242/118.6, 118.61

[56] References Cited

U.S. PATENT DOCUMENTS

| | | | |
|---|---|---|---|
| 3,552,677 | 1/1971 | Hacker | 242/118.61 |
| 3,822,841 | 7/1974 | Campbell | 242/608.6 |
| 4,462,555 | 7/1984 | Olson et al. | 242/118.6 |
| 4,903,913 | 2/1990 | McCaffrey | 242/608.6 |
| 5,143,316 | 9/1992 | Goetz et al. | 242/608.6 X |

*Primary Examiner*—John M. Jillions
*Attorney, Agent, or Firm*—Aquilino & Welsh

[57] ABSTRACT

A knockdown reel comprising a two part tubular hub and having a pair of end flanges releasably attached to opposite ends of the tubular hub by latching means capable of being released in order to separate the end flanges from the hub and thereby minimize the space consumed by said components in packaging, shipping and storing reels of this type. The tubular hub parts include aligning ribs which cooperate with aligning slot in circular recessed sockets on the inner wall of each end flange. The sockets having a bottom wall with curved guide projections thereon spaced radially thereabout in order to guide the ends of the end flanges into proper circumferential engagement with the side walls of the circular sockets.

2 Claims, 3 Drawing Sheets

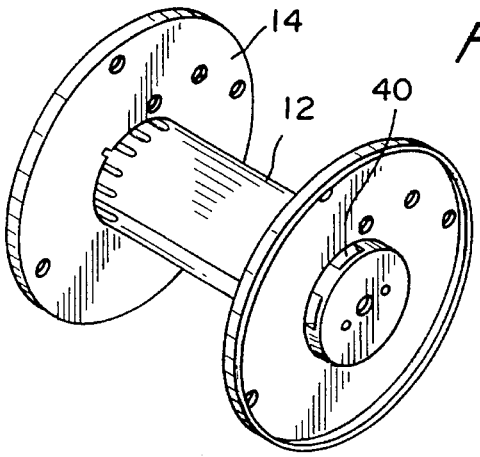
FIG. 9
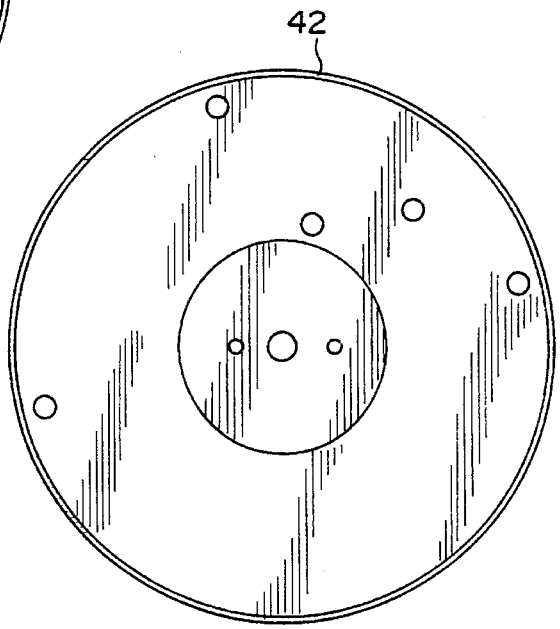
FIG. 11
FIG. 10
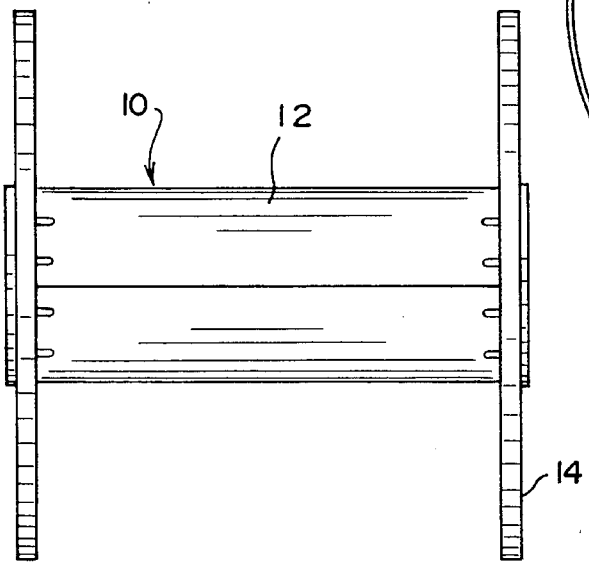
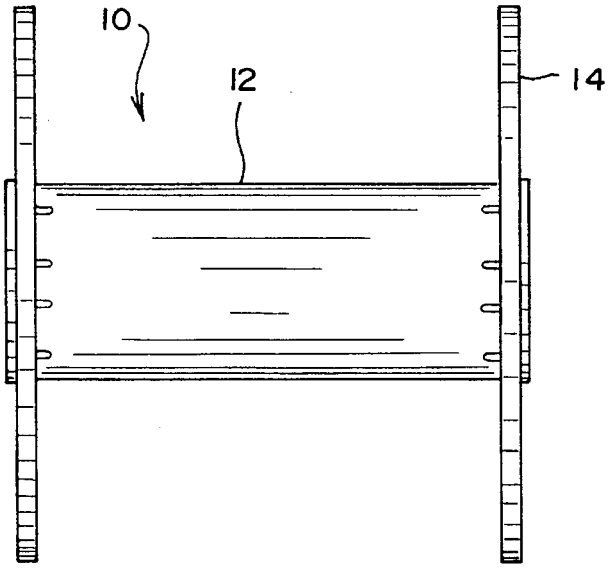
FIG. 12

KNOCKDOWN REEL

BACKGROUND OF THE INVENTION

1. Field of the Invention

The present invention relates to an improved knockdown reel of the type disclosed in U.S. Pat. No. 3,822,841 by the same inventor, which is herein incorporated by reference. The reels comprise a two part tubular hub of predetermined length having latch members on opposite ends thereof engagable with recesses formed in disc-like flanges located at opposite ends of the hub. The knockdown reels may be shipped once the reel has been emptied in knocked down or disassembled condition for purposes of compactness, thereby encouraging reuse and reducing shipping cost. Up to the present time, the prior invention has not met with commercial success as assembly sometimes proved to be difficult. Thus, the present invention has set out to overcome the deficiencies of the prior art. The difficulty in this industry has been the designing of latching means which permit ready assembly of end flanges to the opposite ends of a tubular hub without struggling to align the components and guide the latching means into locking engagement, while also permitting disengagement of the flanges from the tubular hub so that the components could be returned, for example, to the supplier of strand or ribbon like material normally merchandised upon such reels and thus provide certain economies.

Reels of the type to which the present invention pertains are consumed in large quantities by manufacturers and users of strand material such as electric wiring, both insulated and non-insulated, coils of long strips of connected elements formed on punch presses and the like such as partially formed electric contact elements, strips or ribbons of foil type material of such nature as to require being coiled upon reels having end flanges for protection, and many other types of similar products.

2. Description of the Prior Art

Patents pertaining to so called knockdown types of reels are minimal and the most relevant prior art known to the inventor is his prior patent discussed above.

SUMMARY OF THE INVENTION

It is an object of the present invention to provide a knockdown reel comprising a two part tubular hub member with alignment ribs on both ends thereof and a pair of disc-like end flange members each having complementary aligning slots which cooperate with the aligning ribs.

Another object of the invention is to provide a shallow socket on the inner side wall of each end flange member extending outwardly from the normal inner surface of each end flange member and having a bottom wall extending across the outer end of said socket, wherein said bottom wall includes a plurality of curved guide projections extending inwardly towards said inner side wall surface for guiding the ends of the tubular hub into the sockets.

A further object of the invention is to provide radially extending openings at circumferentially spaced locations around said aforementioned socket walls on the end flange members for purposes of receiving radially extending locking abutments on the outer ends of latch elements, formed respectively on opposite ends of the tubular hub member and adapted to be received within said radially extending openings in said short side walls to releasably lock the end flange members to the opposite ends of said tubular hub member.

Still another object of the invention is to form said latch elements on the opposite ends of the tubular hub member so as to be substantially co-extensive in length with said hub member.

A still further object of the invention is to form said end flange members in such a manner that the sockets extend axially outward beyond the outer surface of the end flange members, in coaxial relationship with the hub member, whereby the openings extend radially through the side walls of the socket permit ready contact with the locking abutments on the latching fingers of the hub member when the end flange members are assembled with said hub member and thus readily permit unlatching of the latch members from said openings.

Details of the foregoing objects and of the invention, as well as other objects thereof, are set forth in the accompanying drawings comprising a part thereof.

BRIEF DESCRIPTION OF THE DRAWINGS

FIG. 9 is a perspective view of a second embodiment of the present invention in its assembled state without end flange reinforcing ribs.

FIG. 10 is a side view of the invention shown in FIG. 9.

FIG. 11 is an end elevation view of the invention shown in FIG. 9.

FIG. 12 is a top view of the invention shown in FIG. 9.

DETAILED DESCRIPTION

Referring to the FIGURES, an exemplary reel 10 comprises a preferably tubular hub member 12 and end flange members 14 as shown. The tubular hub member 12 and end flange members 14 are best suited for manufacture from synthetic resin or plastics. Reels of this type, for example, readily and economically may be manufactured from synthetic resin in all sizes. Further, tubular hub members and end flange members of similar design may be formed from sheet metal, by stamping operations, or from suitable metal which is die-cast, particularly in regard to forming the end flange members, while the tubular hub member may be formed by extrusion, either from synthetic resin or metal. Still further, it is conceivable that the invention be made from any suitable material.

For purposes of illustration and simplification of the description of the invention, it is assumed for exemplary purposes that the tubular hub member 12 and flange members 14 are formed from synthetic resin or plastics. The tubular hub member 12 may be formed either unitarily or from two similar sections 12*a* and 12*b* as best shown, in FIG. 2. When formed from two sections each section resembles half of a cylinder which are then interlocked together by way of complementary tabs 20 and 22 on the opposed longitudinal edges of each section. In view of the fact that the opposite ends of said tubular hub member 12 are received within appropriate sockets or recesses, described hereinafter, which are formed in said end of flange members 14, relatively simple interlocking means is all that is necessary as the sockets will provide additional securement.

Figure 7:
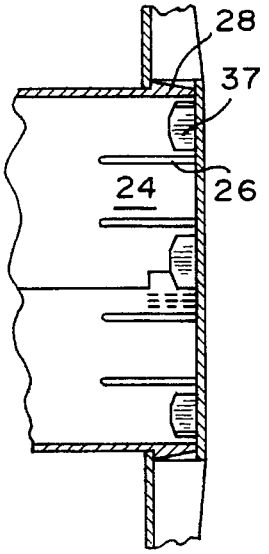
FIG. 7 is a fragmentary, exploded vertical sectioned view showing details of connecting means between one end of the tubular hub member and one of the end flange members as seen through line 7—7 of FIG.3.

Opposite ends of the tubular hub member 12 are provided with alternating latch fingers 24 and guide fingers 27 which are separated by slots 26. Latch fingers 24 are formed of relatively short fingers defined and formed by a pair of parallel slots 26 which extend inward from opposite ends of the hub member 12 and may be formed, for example, simultaneously, such as by utilizing a pair of parallel rotary saws, or otherwise. The outer ends of latch fingers 24 have locking abutments 28 formed thereon in suitable manner to be integral therewith. The abutments project radially outward from the outer surfaces of the latch fingers 24 and the inner faces thereof preferably are perpendicular to the exterior surfaces of said latch members for locking engagement and abutment with complimentary surfaces formed on the end of the flange members 14 as described hereinafter. The material from which the hub members 12 are formed, whether synthetic resin or metal, for example, is relatively stiff but nevertheless adequately resilient to be flexible in order to enable the latch fingers 24 to be flexed. Further, the outer uppermost corners of the locking abutments 28 are beveled to form camming surfaces and thereby facilitate the insertion of the latch members and locking abutments 28 thereon within suitable openings, described below, formed within the walls of the shallow sockets provided in the end of flange members 14. It is preferred that the length of the latch fingers 24 be adequate to enable the same to be readily flexed without subjecting the fingers 24 to undue fatigue over long periods of use. Hence, the fingers 24 should be sufficiently short and of suitable width and thickness so as normally to maintain the same in latched position such as shown in FIG. 7.

Additionally, the tubular hub includes aligning ribs 25 located on guide fingers 27 which are spaced between two latch fingers 24. The aligning ribs 25 cooperate with slots on the end flange members 14 in order to assure that the latch fingers 24 mate with openings to be discussed later.

Figure 1:
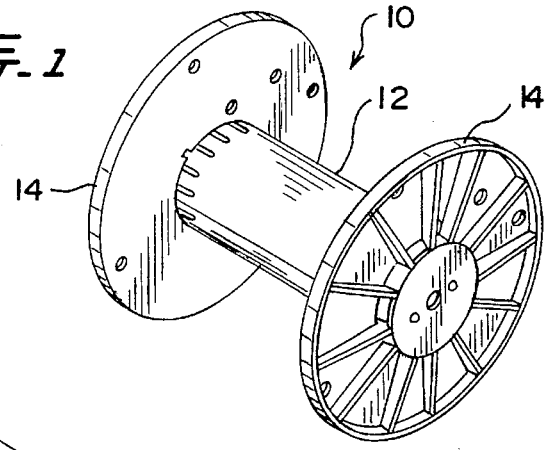
FIG. 1 is a perspective view of the present invention in its assembled state.
Figure 2:
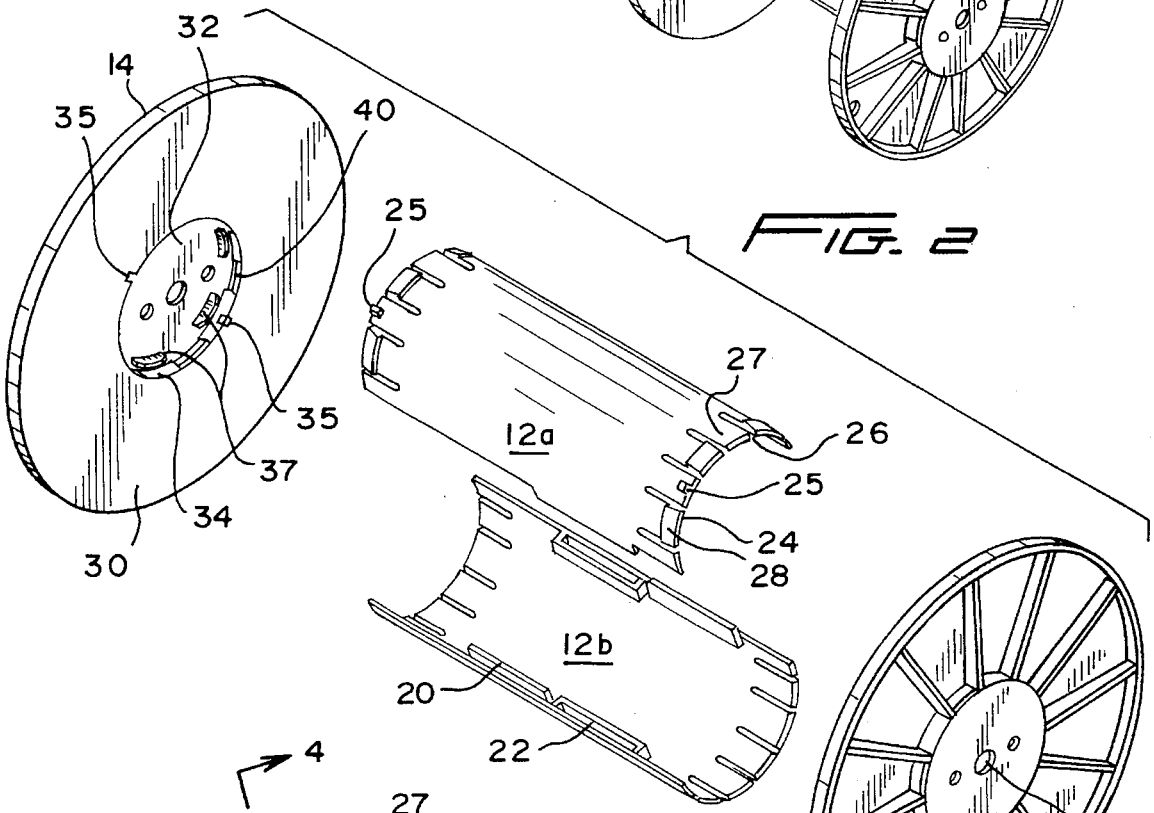
FIG. 2 is an exploded perspective view of a knockdown reel embodying the principals of the present invention.

The end flange members 14 preferably comprise disc-like walls 30 which preferably are planar, but the invention is not to be restricted to such a feature since, if desired, the inner surfaces 30 of the members 14 may be somewhat flatly conical and useful for the coiling of certain types of strand material thereon, if desired. The end flange members 14 are provided with shallow sockets 32 which are shown in FIG. 2. The sockets 32 are defined by short side walls 34 which, in cross section are complimentary to the shape of the tubular hub member 12. The sockets 32 further include aligning slots 35 in the side walls thereof. As illustrated, the tubular hub member is circular in cross-section but it is to be understood that, if desired, other geometric cross-sectional shapes may be employed if desired. The sockets 32 also are defined by a preferably planar end or bottom wall 36 which preferably is provided with a central bearing hole 38 through which a supporting shaft may be extended to support the reel for coiling and uncoiling operations.

Figure 3:
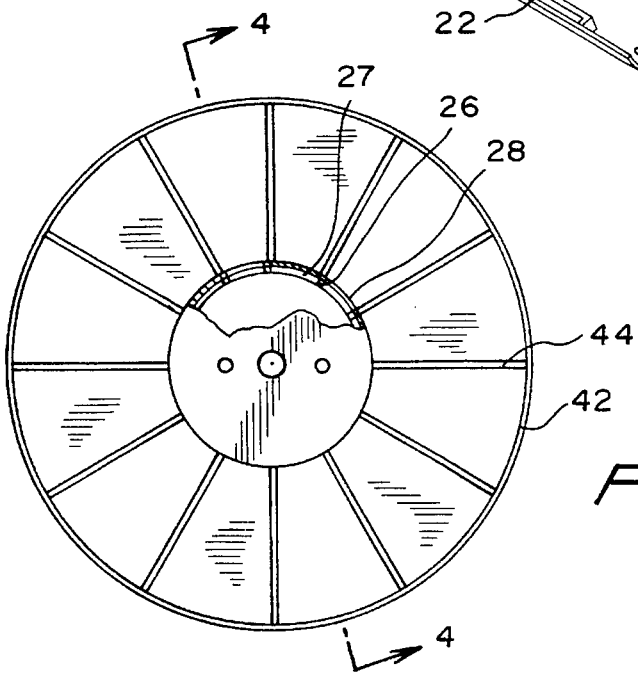
FIG. 3 is an end elevation view of the reel shown in FIG. 1.
Figure 3:
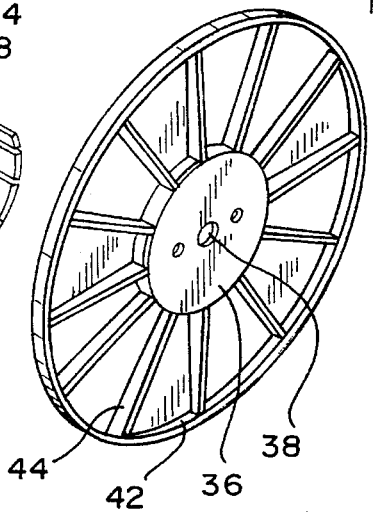
Figure 4:
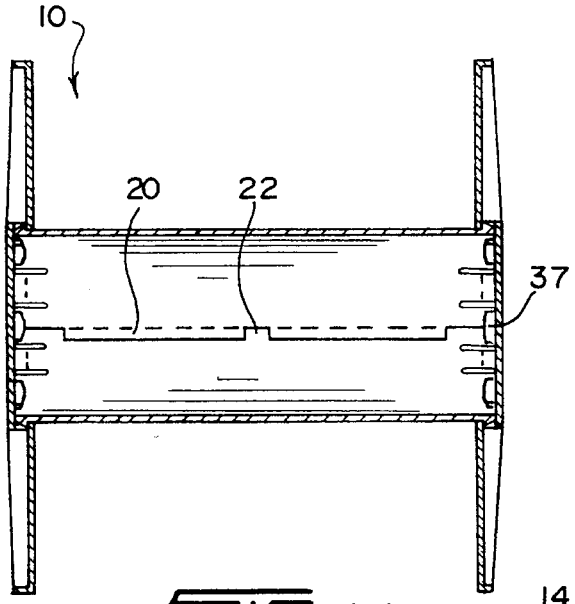
FIG. 4 is a vertically sectioned elevation view taken through a center line of the invention shown in FIG. 5.
Figure 5:
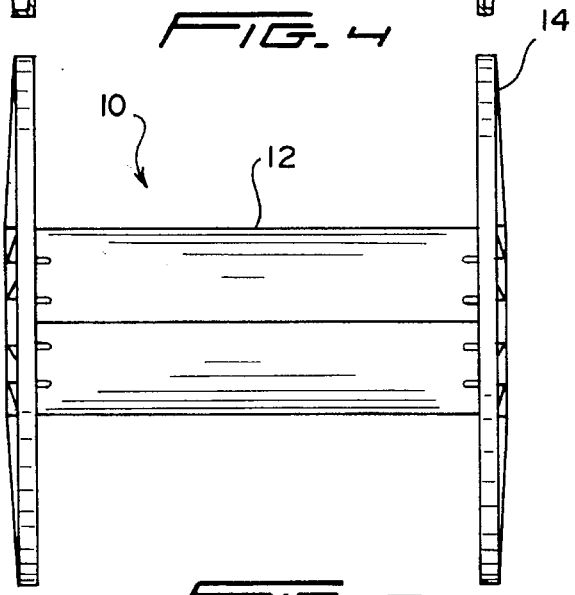
FIG. 5 a side view of the invention shown in FIG. 1.
Figure 6:
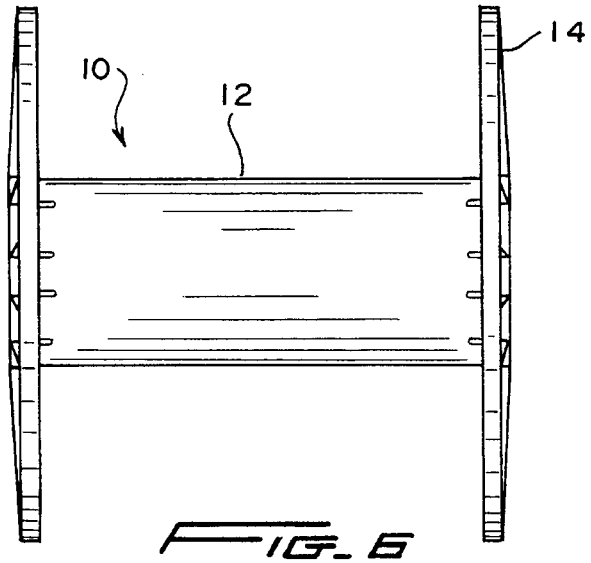
FIG. 6 is a top view of the invention shown in FIG. 1.
Figure 8:
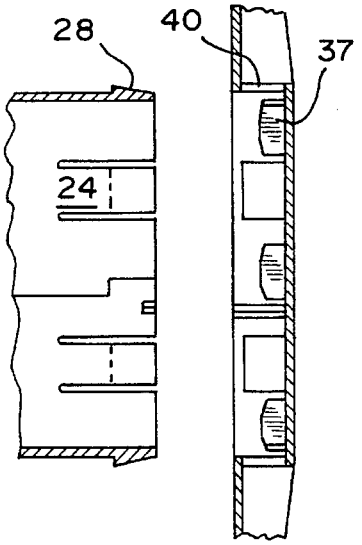
FIG. 8 is a fragmentary, exploded vertical sectioned view showing details of the connecting means between one end of the tubular hub member and one of the end flange members before assembly as shown in FIG. 7.

One of the most important features of the present invention is the provision of projections 37 which are curved in order to be complimentary to the cross-sectional shape of the tubular hub 12. Projections 37 which are spaced from the side walls of sockets 32 are also radially spaced about the bottom walls of sockets 32 as can be seen in FIGS. 2, 3, 4, 7 and 8. AS best seen in FIGS. 2 and 3, these projections function in cooperation with guide fingers 27 to guide the ends of tubular hub 12 into proper circumferential position within sockets 32 on end flanges 14 which increase the ease of assembly and assure that latch fingers 24 do not accidentally release during use. Sockets 32 include openings 40 which are formed to extend entirely through the short side walls 34 thereof and preferably spaced apart circumferentially even distances as shown in an exemplary manner in FIG. 2. The openings receive the locking abutments 28 when one end of the tubular hub member 12 is inserted within socket 32 in each end of flange member 14. The aforementioned camming surfaces on the outer corners of the locking abutments 28 facilitate such insertion and when the end of the tubular hub member 12 is fully inserted into the socket 32, the perpendicular inner radial faces of the locking abutments 28 will snap radially outward through the openings 40 and into locking engagement with the adjacent outer surface of the wall 30 of each of the end of flange members 14. Due to the fact that the outermost surfaces of the locking abutments 28 are freely exposed within the openings 40 when in such latching position, the latch members may be readily engaged either manually, or by a suitable contracting tool, not shown, by which all of the locking abutments 28 may be depressed simultaneously. The end flange members 14 then may be disengaged and removed from the tubular hub member 12 so that the components may be re-used and reassembled, when desired.

In the construction of reels of the type to which the present invention pertains, it is quite customary to reinforce the walls 30, for example, of the end flange members 14 such as by forming a peripheral flange 42 thereon which preferably projects outwardly relative to the hub member 12. Further, additional reinforcement is provided in the form of radial ribs 44 which, preferably, are formed integrally with the walls 30, on the outer surfaces thereof, and similarly, the ribs 44 are integrally connected at the opposite ends thereof respectively with the peripheral flange 42 of each member 14 and also with the exterior surfaces of the short side walls 34 which define the shallow sockets 32.

The embodiment shown in FIGS. 9–12 is exemplary of a knockdown reel wherein the end flanges 14 do not require radial reinforcing ribs for added strength.

While the invention has been described and illustrated in its several preferred embodiments, it should be understood that the invention is not to be limited to the precise details herein illustrated and described since the same may be carried out in other ways falling within the scope of the invention as illustrated and described.

I claim:

1. A knockdown reel comprising:

a tubular hub member formed from two parts releasably interlocked together and including aligning ribs on both ends thereof;

a pair of end flange members each having an inner side wall with a circular recessed socket therein which cooperates with the ends of the tubular hub in order to telescopically receive the ends of the tubular hub, said socket including aligning slots in the side walls thereof which cooperate with the aligning ribs on the tubular hub;

releasable locking means on said socket side walls and said telescopically received portions of said tubular hub member including yieldable latch elements having radially extending locking abutments thereon arranged at circumferentially spaced locations on the telescopically engaging portions of one of said members and radially extending openings in the telescopically engaging portion of the other of said members arranged complementarily to receive said locking abutments of said one of said members and latch the end flange members releasably to the opposite ends of said tubular hub member, said locking abutments being accessible through said radial openings adjacent the outer surfaces of said end flange members for engagement to move said abutments radially in disengaging direction to permit separation of said end flange members from said tubular hub; and wherein the socket includes a bottom wall with radially spaced curved projections thereon extending inwardly toward said inner side wall of said end flange, each said projection spaced from the side walls of the socket a sufficient distance to guide the ends of the tubular member into proper circumferential alignment.

2. The reel according to claim 1 in which said latch elements are on said hub member and said radially extending openings are in said inner side walls on said end flange members.

* * * * *